United States Patent [19]

Welsh et al.

[11] Patent Number: 5,015,192

[45] Date of Patent: May 14, 1991

[54] CONTACT RETENTION AND SEALING SYSTEM

[75] Inventors: David E. Welsh, Tustin; Albert H. Wilson, Los Angeles, both of Calif.

[73] Assignee: ITT Corporation, New York, N.Y.

[21] Appl. No.: 435,111

[22] Filed: Nov. 13, 1989

[51] Int. Cl.[5] ..... H01R 9/09

[52] U.S. Cl. ..... 439/83; 29/843; 29/860; 439/78; 439/589

[58] Field of Search ..... 439/75, 76, 78–83, 439/281, 587, 589, 592, 598, 599, 603, 876; 29/843, 860

[56] References Cited

U.S. PATENT DOCUMENTS

| | | | |
|---|---|---|---|
| 3,634,879 | 1/1972 | Longenecker et al. | 339/176 |
| 3,812,447 | 5/1974 | Eifler et al. | 339/59 |
| 4,374,604 | 2/1983 | Hemmer et al. | 439/587 |
| 4,527,851 | 7/1985 | Gallusser et al. | 339/94 |
| 4,581,678 | 4/1986 | Chambers | 361/331 |
| 4,631,639 | 12/1986 | Biraud | 361/417 |
| 4,645,278 | 2/1987 | Yerak et al. | 439/83 |
| 4,655,517 | 4/1987 | Bryce | 339/17 |
| 4,678,250 | 7/1987 | Romine et al. | 439/83 |
| 4,753,601 | 6/1988 | Cobaugh et al. | 439/62 |
| 4,753,602 | 6/1988 | Peyrat et al. | 439/78 |
| 4,767,344 | 8/1988 | Noschese | 439/83 |
| 4,775,333 | 10/1988 | Grider et al. | 439/736 |
| 4,871,320 | 10/1989 | Mouissie | 439/78 |
| 4,941,847 | 7/1990 | Welsh | 439/589 |

*Primary Examiner*—Paula A. Bradley

*Attorney, Agent, or Firm*—Thomas L. Peterson

[57] ABSTRACT

A method is described for installing contacts with their rear tail ends soldered to holes of a circuit board and their front mating ends insulative housing layers, which facilitates inspection of the solder connections to the circuit board and defluxing of the assembly after soldering. The front contact portions are partially inserted into holes in an elastomeric housing layer (50, FIG. 3) until a first forwardly-facing shoulder (76) on each contact abuts an abutment (92) on the elastomeric layer. The contact rear ends are inserted into corresponding holes in the circuit board (56) until a second rearwardly-facing shoulder on each contact abuts the front face of the board, and the contacts are then soldered to the board. The distance (H, FIG. 2) between the first and second contact shoulders is sufficient to provide a considerable gap (A) between the board and the elastomeric layer, so the solder connectiosn can be visually inspected. Finally, the contacts are pushed further into the housing until the rear face of the elastomeric layer lies facewise against the front face of the board. The elastomeric layer can be formed with a tubular extension (170, FIG. 7) around each plug contact front portion to extend partially into a hole in a more rigid forward insulative layer of the housing. When a socket contact mates with the plug contact, the extreme tip (176) of the socket contact compresses the elastomeric tubular portion to seal to the tubular extension and to compress the tubular extension so it expands and seals against the hole in the more rigid forward layer.

15 Claims, 4 Drawing Sheets

FIG. 1

CONTACT RETENTION AND SEALING SYSTEM

BACKGROUND OF THE INVENTION

Connectors can be mounted to circuit boards, with the tail ends of the contacts soldered to plated-through holes of the circuit board, and with the mating forward ends of the contacts lying in insulative layers of the connector housing. One fabrication method includes projecting the forward contact ends into the insulative layers, projecting the tail ends of the contacts into the circuit board and with the front of the board abutting the connector housing, and then soldering the tail ends to the circuit board as by vapor phase reflow. Such a technique does not allow for visual inspection of the soldered joints, especially on inner rows of contacts, or removal of solder flux that may be trapped between board and insulator. In connectors with higher contact densities, there is an increased susceptibility to solder bridging between adjacent contacts, so visual inspection is highly desirable. It would be possible to insert just the contacts into the circuit board and solder them in place, inspect and deflux the joints, and then insert the front contact ends into the connector housing. However, the front ends of the contacts then may not be accurately aligned with the holes in the insulative layer. This can lead to great difficulty in inserting the contacts into the insulative layers or can lead to breaking of the solder joints during such installation. A connector assembly and method for fabricating it, which enabled visual inspection of solder joints of the contacts with the circuit board and facilitated removal of solder flux, while assuring that the contacts were in alignment with holes in the connector housing during the solder process, would facilitate assembly.

When a plug and socket contact are mated, it is generally desirable to provide a vapor-tight seal around the mating contact portions. This is often accomplished by providing the socket connector with a soft rubber layer that is compressed against a more rigid layer on the plug connector. There is often a wide area of contact, so that for a given mating force there is only a small compression of the rubber. It would be desirable if there were a maximum of rubber compression at the seal, and it occurred immediately around the mating contact locations, so sealing would be assured throughout a range of depths of insertion of one connector into the other and with only a small increase in connector mating force.

SUMMARY OF THE INVENTION

In accordance with one embodiment of the present invention, a connector assembly is provided wherein the contact forward ends lie in a connector housing and the rearward ends lie soldered to holes in a circuit board which facilitates inspection and defluxing of the solder joints during fabrication. Each contact has a middle portion with forward and rearward enlargements and a spacer between them, the rearward enlargement abutting the front face of the circuit board. The front portion of each contact can be pushed forwardly into a rear elastomeric layer of the housing, until a forward shoulder on the forward enlargement abuts an abutment formed on the elastomeric layer, to hold a contact in a partially assembled configuration. The rear portions of the contacts are inserted into the circuit board and soldered thereto. In the partially assembled configuration, at least some of each contact spacer lies in a gap between the rear of the elastomeric layer and the front of the circuit board. The gap provides space for visual inspection of solder connections between the contacts and circuit board and enables penetration of cleaning agents during flux removal. After inspection and defluxing, the contacts are pushed more deeply into the connector housing, with the front enlargement displacing elastomeric material, until the rear face of the elastomeric layer abuts the front face of the circuit board.

In another embodiment of the invention, a plug connector includes a rear elastomeric layer and a more rigid insulative layer in front of it. The elastomeric layer is formed with tubular portions that project forwardly into the holes in the more rigid forward layer. When the socket contacts of a mating connector enter the holes in the forward layer, the tips of the sockets compress the front ends of the elastomeric tubular portions, to form a seal against them, and to also deform the tubular portions so they expand against the more rigid layer to form a seal thereagainst.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
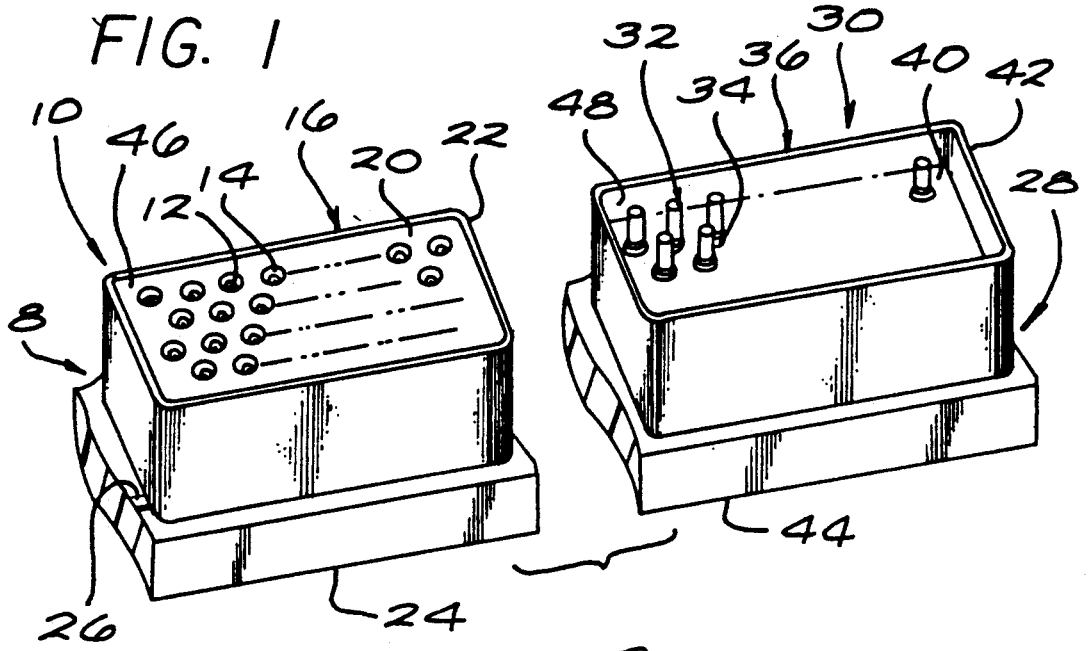
FIG. 1 is an exploded perspective view showing plug and socket connector assemblies constructed in accordance with the present invention, that can be mated to each other.

FIG. 1 illustrates a plug connector assembly 8 which includes a plug connector 10 and a circuit board 24 at the rear of the connector. The plug connector includes multiple plug or pin contacts 12 lying in holes 14 of a connector housing 16. The housing includes an insert or insulation 20 and a shell 22 around the insulation. The connector 10 is mounted on the circuit board 24, with the multiple contacts 12 connected to conductive traces such as shown at 26 on the circuit board. The system also comprises a socket connector assembly 28 which includes a socket connector 30 coupled to a second circuit board 44. The second socket connector 30 has multiple socket contacts 32 lying in holes 34 of an insert or insulation 40 of a housing 36 that includes a shell 42 that surrounds the insulation. The two connectors 10, 30 have forward or mating ends, 46, 48 and can be connected together by moving their mating ends against each other, with each contact of a plug connector 10 mating with a corresponding contact of the socket connector 30.

Figure 2:
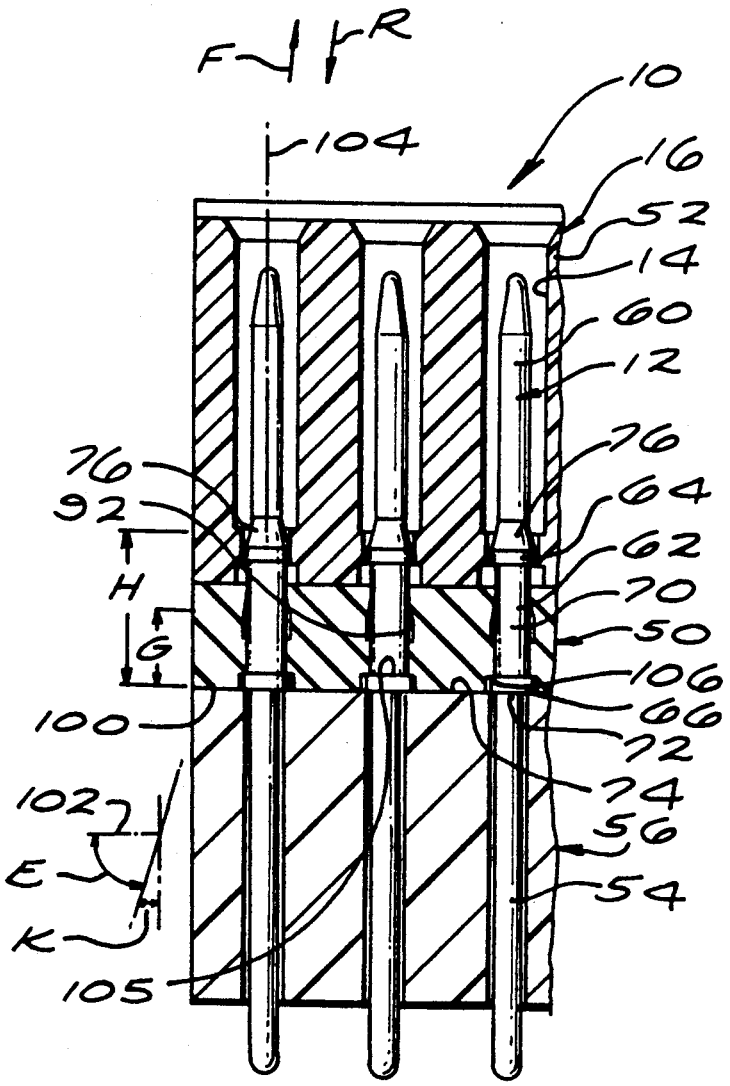
FIG. 2 is a partial sectional view of the plug connector assembly of FIG. 1, shown in a fully assembled configuration.

FIG. 2 illustrates a portion of the plug connector 10, showing how the pin contacts 12 are held in the holes 14 of the connector housing 16. The housing includes a first layer 50 of elastomeric material such as rubber, and a second layer 52 of a rigid insulative material such as a rigid plastic. Each contact has a rearward or tail portion 54 lying in the circuit board 56 and a forward mating portion 60 lying in the rigid second housing layer 52. Each contact also has a middle portion 62 between the forward and rearward portions, with the middle portion having forward and rearward enlargements 64, 66 and a spacer 70 of smaller diameter than either enlargement lying between them. The rearward enlargement has a rearwardly-facing shoulder 72 that abuts a front face 74 of the circuit board to withstand mating forces applied in the rearward direction R.

Figure 3:
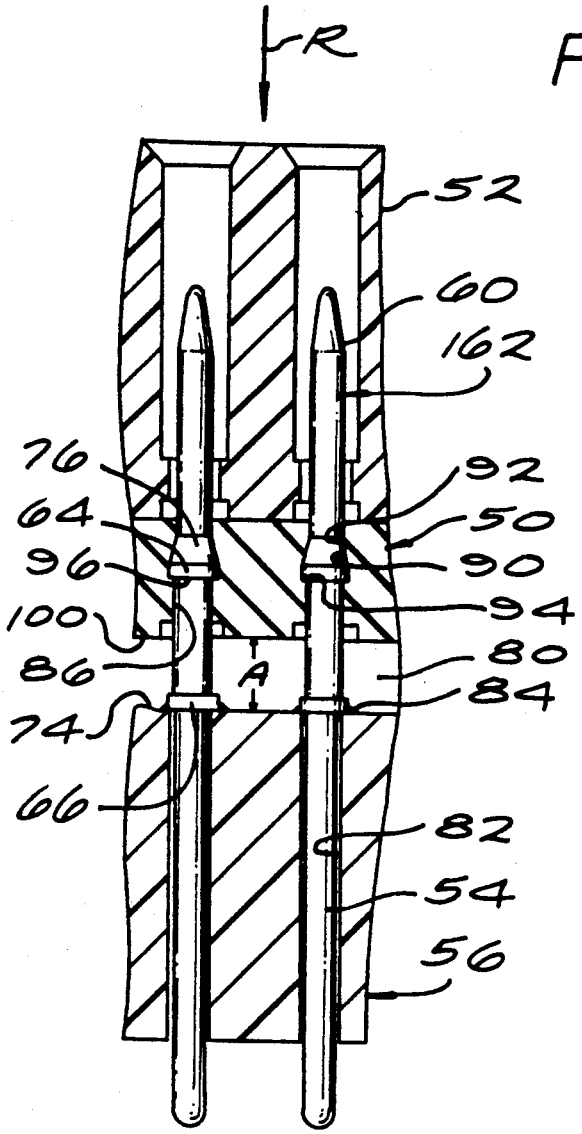
FIG. 3 is a view of the connector assembly of FIG. 2, in a partially assembled configuration.

The forward enlargement 64 of each contact has a forwardly-facing shoulder 76 that is useful to hold the contact in position in the partially assembled connector assembly shown in FIG. 3. In the partially assembled configuration, the first or elastomeric layer 50 and the circuit board 56 are spaced apart by a distance A to leave a considerable space or gap 80 between them. In this configuration, the rearward or tail portions 54 of the contacts are soldered to plated-through holes 82 in the circuit board. During such soldering, a small amount of solder indicated at 84 will often lie between the front face or abutment 74 of the circuit board and an adjacent part of the contact such as the rearward enlargement 66. For contacts with high densities (small spacing of the contacts from one another) there is an appreciable possibility that the solder will bridge a pair of adjacent contacts. As a result, it is highly desirable that the front surface 74 of the circuit board be capable of being defluxed and visually inspected before final assembly of the contacts. However, during such soldering and inspection the contacts must lie at least partially in the insulation layers so that the contacts are accurately aligned with the holes in the housing and final assembly is easily accomplished without damage. The construction of the present connector enables such partial assembly of the contacts, at which time soldering and inspection of the soldered joints can be accomplished; this can be followed by final assembly in a simple manner that avoids damaging of the contacts and housing layers.

Applicant initially assembles the contacts by inserting the forward mating portions 60 through the rear of the first and second layers to the position shown in FIG. 3, and inserting the contact rearward tail portions 54 into the holes 82 in the circuit board. It is important that the contacts remain in the predetermined positions shown in FIG. 3 for the partially assembled connector assembly during the soldering and inspection processes. The forward portions of the contacts are kept in place by forming the hole 86 in the elastomeric layer with a hole enlargement 90 that receives the contact front enlargement 64. The hole enlargement forms a rearwardly-facing abutment 92 that engages the forwardly-facing shoulder 76 on the contact to resist forward movement of the contact in the hole. The hole enlargement also forms a forwardly-facing abutment 94 that engages a rearwardly-facing shoulder 96 on the forward enlargement. Thus, with the forward enlargement 64 in the hole enlargement 90, the contact resists moving in the elastomeric layer, so the contacts are held in position until soldering, defluxing, and soldering inspection is completed. The distance H between the forwardly and rearwardly-facing shoulders 76, 72 is preferably more than 10% greater than the distance G between the hole abutment 92 and the rear face 100 of the elastomeric layer to assure a large gap 80.

After soldering is completed, the housing, including the first and second layers 50, 52 thereof, are pressed rearwardly in the direction of arrow R until the rear face 100 of the elastomeric layer substantially abuts the forward face 74 of the circuit board. (It is possible to have a thin additional layer between them). To facilitate such movement, the contact forwardly-facing shoulder 76 preferably extends at an angle E of at least 45° from an imaginary plane 102 that is perpendicular to the axis 104 of the contact, or in other words the shoulder 76 extends at an angle K of no more than 45° and preferably no more than 30° with the axis 104. In the final assembled position, the rearwardly-facing shoulder 72 on the rearward enlargement of the contact, which extends substantially perpendicular to the contact axis as seen in the side views, lies against the front face 74 or abutment on the circuit board to withstand mating forces. Also, a forwardly-facing shoulder 105 on the rearward enlargement lies against an abutment 106 on the elastomeric layer to resist unmating forces (in conjunction with the solder connection).

FIGS. 4–9 illustrate details of another connector system which also enables the inspection of solder joints between a circuit board and connector contacts and the removal of flux thereat, while the front ends of the contacts lie partially within a connector housing to assure their alignment. As will be discussed later, the embodiment of FIGS. 4–9 also facilitate the sealing of the contact-engaging region of plug and socket contact. The outside appearance of the plug connector assembly 110 and a mating socket connector assembly (112 in FIG. 7) is the same as that shown in FIG. 1, although the details are different from those of the connector assemblies of FIGS. 2 and 3.

Figure 4:
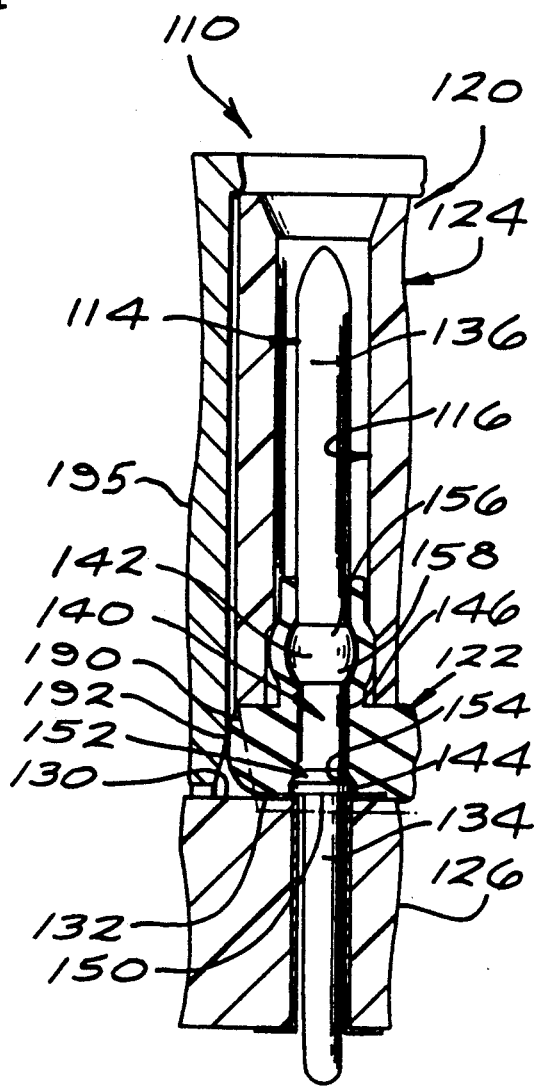
FIG. 4 is a partial sectional view of a plug connector assembly constructed in accordance with another embodiment of the invention, shown in a fully assembled configuration.

FIG. 4 illustrates the connector assembly 110 in a fully assembled configuration. The connector includes plug contacts 114 lying in holes 116 of a connector housing 120. The housing includes an elastomeric insulative rearward layer 122 and a more rigid insulative forward layer 124. A circuit board 126 of the assembly has a forward face 130 that abuts the rear face 132 of the elastomeric layer in the fully assembled configuration. Each contact has a rearward or tail portion 134 lying within the circuit board 126 and soldered thereto, a forward mating portion 136 lying in the housing forward layer 124, and a contact middle portion 140 lying between the contact forward and rearward portions. The middle portion includes forward and rearward enlargements 142, 144 and a spacer 146 between them. The rearward enlargement 144 forms a rearwardly-facing shoulder 150 that abuts the front face 130 of the circuit board configuration, and forms a forwardly-facing shoulder 152 that abuts the rear face of the elastomeric layer, the rear face of the elastomeric layer forming an abutment 154 at its rear face. The forward enlargement 142 also forms forwardly-facing and rearwardly-facing shoulders 156, 158.

Figure 5:
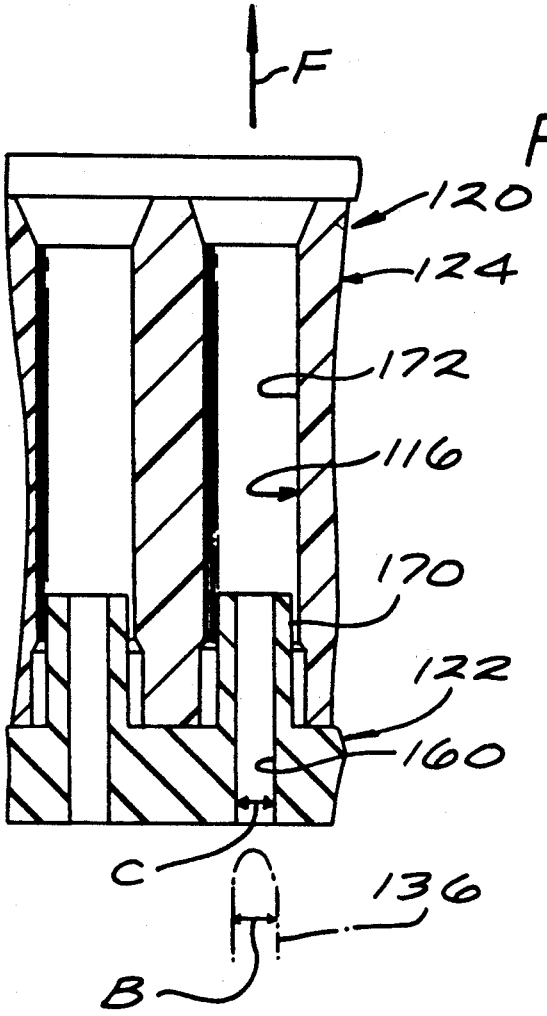
FIG. 5 is a partial sectional view of just the housing of the connector assembly of FIG. 4.

FIG. 5 illustrates one step in the fabrication of the connector assembly, which includes positioning the basically cylindrical contact front portion 136 behind a hole 160 in the elastomeric layer 122 and pushing the contact tapered front end and mating portion in a forward direction F into the hole. The diameter B of the contact mating or forward portion is greater than the diameter C of the hole in the elastomeric layer by a sufficient amount that is preferably at least 1% and preferably over 2% to ensure a fairly tight interference fit. In one example of a connector that has been designed, the contact forward portion diameter B was 25 mil (one mil equals 1/1000th inch) while the hole diameter C was 20 mil, for an interference of 5 mil.

Figure 6:
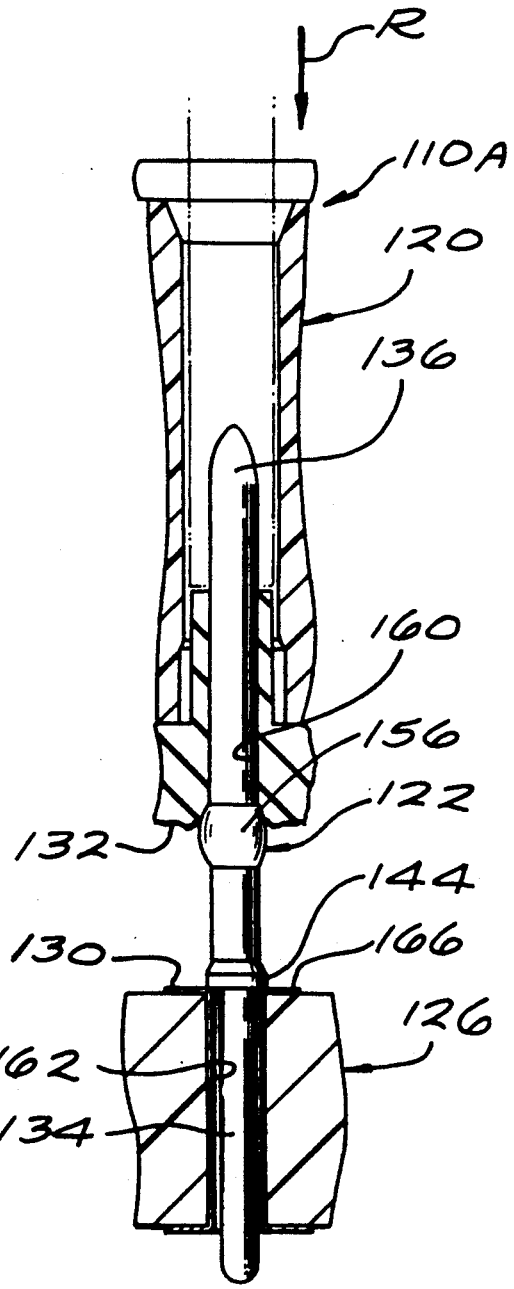
FIG. 6 is a partial sectional view of the connector assembly of FIG. 4, shown in a partially assembled configuration.

FIG. 6 shows the contact pushed forwardly into the insulative layers until the forwardly-facing shoulder 156 of the forward enlargement 122 abuts the abutment formed by the rear face 132 of the elastomeric layer around the hole 160 therein. The tail portion 134 of the contact lies in a plated-through hole 162 of the circuit board. The contacts are then ready for soldering to the hole in the circuit board, as by vapor phase reflow where the contact and/or walls of the circuit board hole .have already been coated with solder.

In the partially assembled configuration 110 A of FIG. 6, the contact is held in a secure predetermined position in the connector housing 120. The abutment of the connector forward enlargement 122 with the rear of the elastomeric layer controls the depth of contact insertion while allowing slight variation (so the rearward enlargement of all contacts can abut the circuit board). The interference fit of the contact forward portion 136 with the walls of the hole 160 in the elastomeric layer prevents movement of the contact within the layer after it has been inserted to the depth shown in FIG. 6. The contacts are inserted deeply enough into the elastomeric layer to assure their alignment when later inserted to full depth. It may be noted that the insertion of the contact tail portions 134 into the plated-through holes of the circuit board is not sufficient to accurately align the contacts because the circuit board holes are made large enough to assure easy insertion of the contact tail portions therein.

In the configuration of FIG. 6, the rear tail portions 134 and rear enlargements 144 of the contacts are soldered in place, defluxed, and visually inspected. Thereafter, the connector housing 120 is pushed in the rearward direction R until the rear face 132 of the elastomeric layer substantially abuts the front face 130 of the circuit board. It may be noted that the circuit board typically includes conductive pads 166 on each face around each hole, and the elastomeric layer may abut such pads of the circuit board. FIG. 4 shows the connector assembly in the final configuration.

Figure 7:
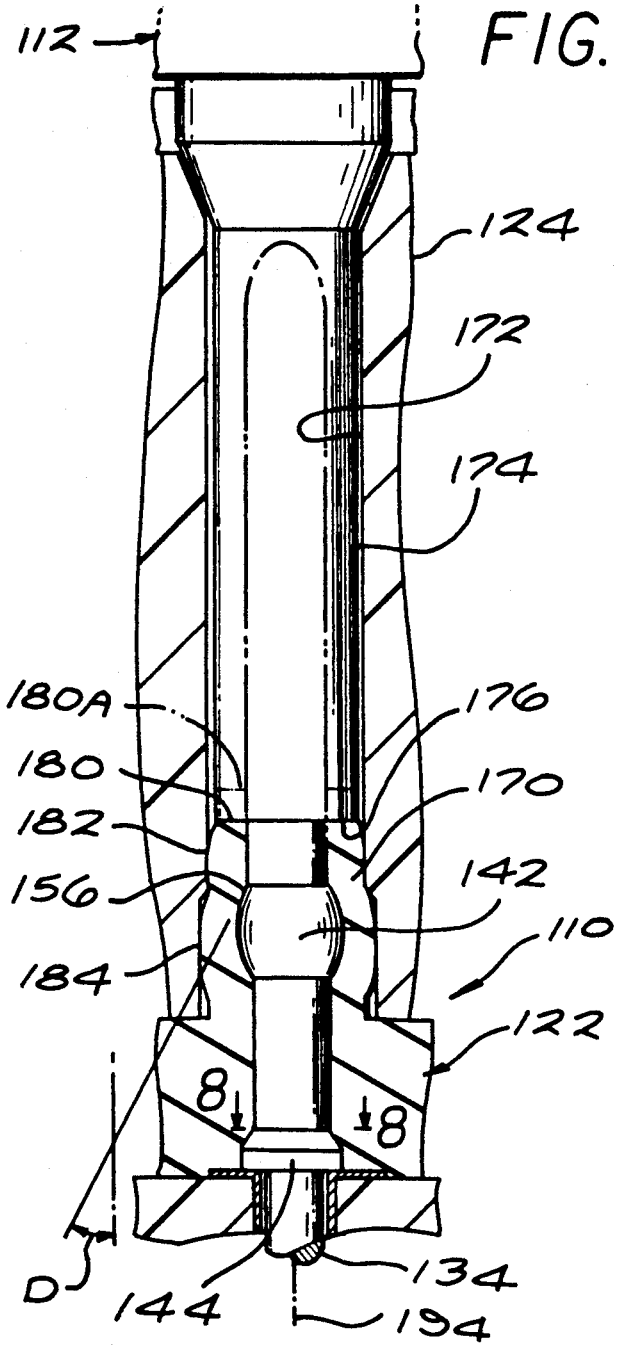
FIG. 7 is a partial sectional view of the connector assembly of FIG. 4, shown with a mating socket connector assembly.
Figure 8:
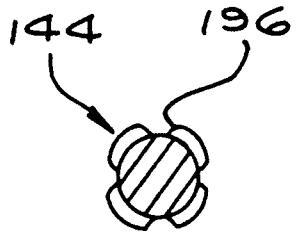
FIG. 8 is a view taken on the line 8—8 of FIG. 7.

As shown in FIG. 5, the elastomeric layer 122 has a plurality of tubular portions 170 that extend forwardly into the rearward portions of holes 172 in the forward rigid insulative layer 124. Each tubular portion 170 closely surrounds an installed contact. As shown in FIG. 7, each elastomeric layer tubular portion 170 is used to effect a vapor-tight seal with a socket contact 174 of the socket connector assembly 112. When the socket contact is fully installed in the hole 172 of the forward housing layer 124, the extreme end 176 of each socket depresses the extreme front end 180 of the tubular portion 170 to compress it from a position 180 A to the position 180. This results in a vapor-tight seal at the faces 176, 180. The considerable compression of the elastomeric tubular portion 170 also results in expansion of the elastomeric tubular portion so it presses tightly against the walls of the hole 172 in the rigid forward housing layer, as at the locations 182 and 184. This also helps to seal against moisture that might affect the rear tail portion of the contacts. The forward enlargement 142 of each contact deforms the tubular portion into an initial outward bulge so that the tubular portion tends to expand outwardly when its front end is depressed, to help assure controlled expansion of the tubular portion in sealing contact with the walls of the surrounding hole in the forward layer. The forward contact enlargement 142 also helps to provide a local region of large interference fit of the contact with the elastomeric layer to withstand unmating forces.

Referring to FIG. 4, screw fasteners can be used to tightly hold a metal shell 195, a shell washer 195 of the connector housing, and the housing layers, against the circuit board 126. Full tightening of the screws causes thickness or height compression of the elastomeric layer 122. Such height compression results in sideward expansion of the elastomeric layer 122 in accordance with Poisson's ratio. As the layer 122 expands sidewardly, its side edge which is initially at the position 190 expands to the position 192 against the metal shell 195 to provide a seal thereat.

As shown in FIG. 7, the forwardly-facing shoulder 156 of the forward enlargement 142 extends at a relatively small angle D which is less than 45° and preferably less than 30° with the axis 194 of the contact. This enables forward movement of the forward enlargement 142 along the hole in the elastomeric layer while avoiding damage to the walls of the hole in the elastomeric layer. It also may be noted that in the final installed position, the rearward enlargement 144 presses into the rear of the elastomeric layer. Screws (not shown) hold the connector tightly against the circuit board so the elastomeric layer 122 is compressed; the elastomeric layer is a relatively soft material such as rubber of sixty shore hardness to enable such deformation without significant damage. It may be noted that the rear projection 144, shown in FIG. 8, has recesses 196, which provide space for good solder connections.

Figure 9:
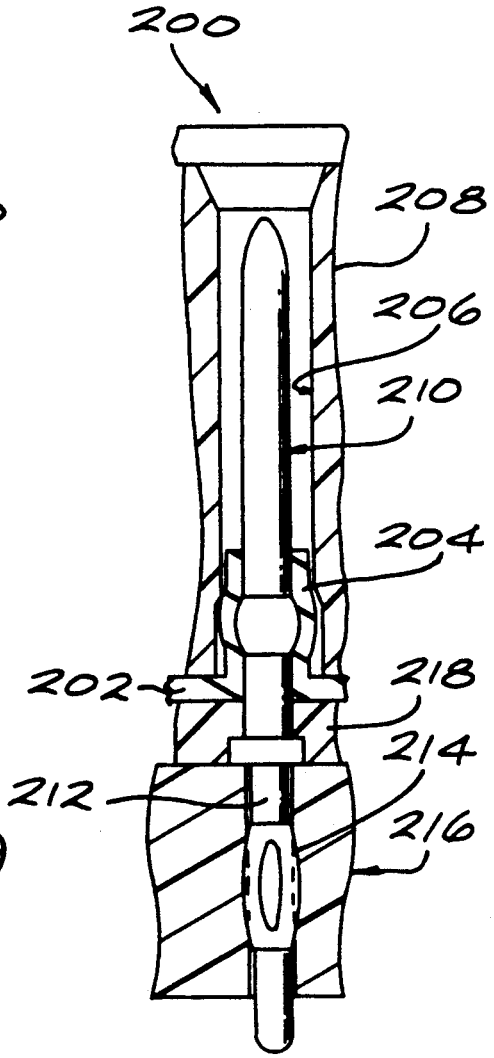
FIG. 9 is a partial sectional view of a connector assembly constructed in accordance with another embodiment of the invention.

The use of elastomeric tubular portions 170 that extend into the more rigid forward layer is useful in a variety of connector designs. FIG. 9 illustrates a connector assembly 200 with an elastomeric layer 202 having a tubular extension 204 that extends into a hole 206 of a more rigid forward layer 208. This particular contact 210 has a tail portion 212 with a resiliently compressible part 214 that is not soldered to a circuit board 216, but is attached by forcing the compressible part 214 into a circuit board hole to assure tight contact between the plated circuit board hole and the contact. The housing includes another rigid layer 218 rearward of the elastomeric layer 202. However, the tubular portion 204 of the elastomeric layer still serves to provide a seal around the mating portions of a socket contact and the plug or pin contact 210 by compression of the extreme front end of the tubular portion and its expansion against the walls of the hole 206.

Thus, the invention provides a connector assembly and method for fabricating it, wherein the tail ends of the contact can be inspected and defluxed after soldering to a circuit board, before more forward portions of the contact are fully installed in insulative layers of the connector housing. This is accomplished by forming each contact with a forwardly-facing shoulder that abuts an abutment on an elastomeric layer of the connector housing to hold the contact in a partially installed position. At the same time, a rearwardly-facing shoulder spaced rearward of the forwardly-facing shoulder abuts a forward face of the circuit board to be soldered thereto. Afterwards, the forwardly-facing contact shoulder can be forced more deeply into the elastomeric layer while avoiding damage thereto, by forming the shoulder with a taper. The connector assembly, which has plug or pin contacts, also provides a seal with the tip of a socket contact, and provides a seal at the rear of the contact-receiving hole. This is accomplished by forming an elastomeric layer of the housing with a tubular portion that surrounds the contact and that projects forwardly into a more forward insulative layer. The tip of a mating socket contact compresses the forward tip of the tubular portion to form a seal thereat and to cause the tubular portion to bulge outwardly against the forward insulative layer.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector assembly comprising:

a circuit board having a plurality of holes and having a forward face;

a housing which includes an insulative elastomeric layer having a plurality of contact-receiving holes aligned with said holes in said circuit board and having a rear face substantially abutting the forward face of said circuit board;

a plurality of contacts lying in said holes of said elastomeric layer and board in fully installed positions therein, each contact including a forward mating portion, a rearward tail portion, and a middle portion between said forward and rearward portions, said middle portion having forward and rearward enlargements and a spacer of smaller diameter than said enlargements lying between them, said rearward enlargement having a rearwardly-facing shoulder abutting said circuit board forward face to withstand mating forces;

said holes in said elastomeric layer each being narrow enough that the forward enlargement of a corresponding contact can be pushed forwardly into the rear of the elastomeric layer to said final contact position only by forcing the contact forwardly with enough force to deform and displace elastomeric material at the walls of the hole, and each said forward enlargement having a forwardly-facing shoulder large enough to abut a location on said elastomeric layer to temporarily hold said contact in a partially installed position at which said rearwardly-facing shoulder on said rearward enlargement lies a predetermined distance rearward of the rear face of said elastomeric layer.

2. The connector assembly described in claim 1 wherein:

each of said contacts has an axis, and each forwardly-facing shoulder is tapered so most of it extends at an angle of less than 45° with said axis, to allow the forward enlargement to pass forwardly through at least part of said elastomeric layer while avoiding damage thereto.

3. The connector assembly described in claim 1 wherein:

said contact tail portion is soldered to said circuit board hole in a fully assembled configuration of said connector assembly;

said elastomeric layer has a hole enlargement (90) that receives said contact forward enlargement in a partially assembled connector assembly configuration;

said contact forward enlargement and the walls of said hole enlargement respectively forming a forwardly-facing shoulder and a rearwardly-facing abutment that abut one another in said partially assembled configuration;

the distance (H) between said contact forwardly-facing shoulder and rearwardly-facing shoulder being at least 10% greater than the distance (G) between said elastomeric layer rearwardly-facing abutment and said elastomeric layer rear face, so said board front face is spaced rearwardly from said elastomeric layer rear face in said partially assembled configuration.

4. The connector assembly described in claim 1 wherein:

said contact mating portion has an elongated cylindrical shape with a tapered front end;

said elastomeric hole has a substantially constant diameter that is at least 1% smaller than said contact cylindrical portion, to assure a high frictional holding face of said contact mating portion in said elastomeric layer in a partially assembled configuration of said connector assembly.

5. The connector assembly described in claim 1 wherein:

said housing includes a shell lying about said elastomeric layer and having an inside surface facing said elastomeric layer and lying adjacent therewith, and fasteners for pressing said elastomeric layer against said circuit board;

said elastomeric layers extending rearwardly further than said shell when not compressed in thickness, said elastomeric layer lying close enough to said shell that when said screws are fully tightened said elastomeric layer is compressed sufficiently in thickness that it expands sidewardly into a vapor tight sealing relationship with said shell.

6. The connector assembly described in claim 1 wherein:

said housing includes a second insulative layer lying forward of said first mentioned elastomeric layer, said second layer having holes aligned with the holes in said first layer;

said first elastomeric layer having a tubular portion extending forwardly into each of said holes in said second layer, each tubular portion being deformable to expand against the walls of the corresponding hole in said second layer when the front end of the tubular portion is pressed rearwardly.

7. An electrical connector comprising:

a housing having a rearward elastomeric layer and a forward insulative layer, said layers having a plurality of aligned holes, said holes in said forward layer having rearward portions;

a plurality of contacts, each lying in a pair of said aligned holes and having a pin type front mating portion lying in said forward layer, said holes in said forward layer each having a greater diameter than said contact mating portion to receive a socket contacting element that surrounds and mates with said contact mating portion;

said elastomeric layer having a plurality of tubular portions extending forwardly into the rearward portions of said first layer holes and surrounding said contacts, said tubular portions having extreme forward ends, each tubular portion being deformable by rearward forces against its extreme front ends by one of said socket contacts to seal thereagainst.

8. The connector described in claim 7 wherein:

each of said tubular portions is deformable by rearward forces against its extreme front end, so the tubular portion expands against the walls of a corresponding hole in said forward layer.

9. The connector described in claim 8 wherein:

each of said contacts has an enlargement of greater diameter than the forward mating portion of the contact and lying within one of said forwardly-extending tubular portions of said elastomeric layer, whereby to help control expansive deformation of the tubular portion.

10. A method for the construction of an electrical connector assembly by placing a plurality of contacts with front mating ends in a housing and rear tail ends in the holes of a circuit board that has a front face facing said housing, comprising:

forming a plurality of contact-receiving holes in a layer of elastomeric insulative material of said housing, so said contact-receiving holes dan all be established in alignment with said holes in said circuit board, with each hole in the elastomeric layer formed with a rearwardly-facing abutment;

forming a plurality of contacts so each has a mating front end, a rear tail end, a first forwardly-facing shoulder, and a second rearwardly-facing shoulder lying behind said first shoulder;

inserting the front end of each contact forwardly into said housing through a hole in said elastomeric layer until said first contact shoulder abuts said rearwardly-facing abutment in said elastomeric layer;

inserting each contact rear tail end rearwardly through a hole in said circuit board until said second contact shoulder abuts said circuit board, and soldering each contact rear tail end to said circuit board;

after said step of soldering, pushing each contact front end forwardly further into said elastomeric layer until the front face of said circuit board substantially abuts said housing.

11. The method described in claim 10 wherein:

said step of forming contacts includes forming contacts with first and second enlargements respectively forming said first and second shoulders and with a spacer of smaller diameter than said enlargements lying between them;

said step of forming holes in said elastomeric layer includes forming each hole therein with a hole enlargement having a forward end that forms said rearwardly-facing abutment;

said step of inserting includes initially inserting each contact into said elastomeric layer until said second enlargement lies in said hole enlargement, and after said step of soldering, pushing each contact forwardly until said second enlargement lies forward of said elastomeric layer.

12. The method described in claim 10 wherein:

said elastomeric layer has a rear face and said rearwardly-facing abutments are formed by the rear face of said elastomeric layer;

said step of forming contacts includes forming them with first and second enlargements respectively forming said first and second shoulders, and forming said contact front ends with larger diameters than said holes in said elastomeric layer;

said step of inserting includes initially inserting each contact forwardly into said elastomeric layer until said first enlargement abuts an abutment at the rear face of said elastomeric layer.

13. A method for installing a plurality of contacts that each have a forward mating portion and a rearward tail portion, in the holes of a circuit board, in the holes of an elastomeric layer, and in the holes of a more rigid and more forward layer, with each contact tail portion soldered to the circuit board, and with a rear shoulder on each contact abutting a forwardly-facing board surface, comprising:

forming each of said holes in said elastomeric layer with a partially rearwardly-facing forward abutment spaced a predetermined first distance (G) forward of a rear face of the elastomeric layer;

forming each of said contacts with a partially forwardly-facing forward shoulder that is spaced forwardly of the contact rear shoulder by a second distance (H) that is more than 10% greater than said first distance;

inserting said contact forward portions into said housing and said contact rearward portions into said circuit board, with each contact rear shoulder lying against a board surface and with each contact forward shoulder lying against one of said forward abutment, and with said board and elastomeric layers separated so there is a wide gap between them;

soldering said contact tail portions to said board while said gap lies between said board and elastomeric layer;

after said step of soldering, moving said board and contacts forwardly with respect to said elastomeric and rigid layers, including pushing said contacts forwardly so said contact forward shoulders move forwardly of said elastomeric layer forward abutment.

14. The method described in claim 13 wherein:

said step of forming said contacts includes forming a forward enlargement on each contact which forms said forward shoulder and which also forms a third shoulder (96) which faces rearwardly, each contact having an axis and said forward shoulder extending at an angle K of no more than 45° from the contact axis;

said step of forming said holes in said elastomeric layer includes forming each hole to have an enlarged portion with walls including said forward abutment, that substantially abut both of said flange shoulders.

15. A method for installing a plurality of contacts that each have a forward mating portion and a rearward tail portion, in the holes of a circuit board, in the holes of an elastomeric insulative layer, and in the holes of a more rigid and forward insulative layer, with each tail portion soldered to the walls of a circuit board hole, and with a rearwardly-facing shoulder on each contact abutting a forwardly-facing board surface, comprising:

forming each contact with a contact forward mating portion having a cylindrically shaped of a diameter greater than each corresponding hole in said elastomeric layer, with a partially forwardly-facing forward shoulder of greater diameter than said cylindrical shape forward mating portion, and with said rearwardly-facing shoulder spaced behind said forwardly-facing shoulder;

inserting each contact mating portion forwardly into a hole in said elastomeric layer, until said contact forwardly-facing shoulder abuts the rear face of said elastomeric layer;

inserting each contact rearward tail portion rearwardly into a hole in said circuit board until said contact rearward shoulder abuts said forwardly-facing board surface and then soldering the contact to the board;

after said step of soldering, pushing each contact forwardly more deeply into a corresponding elastomeric layer until said forwardly-facing shoulder lies in said elastomeric layer and said contact mating portion lies in said forward layer.

* * * * *